US011276363B2

(12) United States Patent
Li et al.

(10) Patent No.: US 11,276,363 B2
(45) Date of Patent: Mar. 15, 2022

(54) DISPLAY DRIVING CONTROL CIRCUIT, DISPLAY PANEL AND DRIVING CONTROL METHOD

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Yafei Li, Beijing (CN); Zijiao Xue, Beijing (CN); Lukang Li, Beijing (CN); Xiaojing Wang, Beijing (CN); Xin Duan, Beijing (CN); Lingyun Shi, Beijing (CN); Xiurong Wang, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 60 days.

(21) Appl. No.: 16/576,634

(22) Filed: Sep. 19, 2019

(65) Prior Publication Data

US 2020/0294433 A1 Sep. 17, 2020

(51) Int. Cl.
*G09G 3/36* (2006.01)
*G09G 3/00* (2006.01)

(52) U.S. Cl.
CPC ..... *G09G 3/3677* (2013.01); *G09G 3/006* (2013.01); *G09G 3/3614* (2013.01); (Continued)

(58) Field of Classification Search
CPC .... G09G 3/006; G09G 3/3614; G09G 3/3677; G09G 2310/02; G09G 2310/0202; (Continued)

(56) References Cited

U.S. PATENT DOCUMENTS

| | | | | |
|---|---|---|---|---|
| 9,952,478 | B2 * | 4/2018 | Hong | G09G 3/3688 |
| 2016/0078836 | A1 * | 3/2016 | Kim | G09G 3/3688 345/209 |
| 2016/0180791 | A1 * | 6/2016 | Lee | G09G 3/3614 345/213 |

* cited by examiner

*Primary Examiner* — Jason M Mandeville
(74) *Attorney, Agent, or Firm* — Kinney & Lange, P.A.

(57) ABSTRACT

A display driving control circuit, a display panel, and a driving control method are disclosed. A driving control sub-circuit in the display driving control circuit includes a first data selection sub-circuit, a second data selection sub-circuit, a third data selection sub-circuit, and a fourth data selection circuit. The first data selection sub-circuit, the second data selection sub-circuit, the third data selection sub-circuit, and the fourth data selection circuit are electrically connected to a first selection signal line respectively. The first data selection sub-circuit and the third data selection sub-circuit are electrically connected to a first data channel signal line, and the second data selection sub-circuit and the fourth data selection sub-circuit are electrically connected to a second data channel signal line. Each of the first data selection sub-circuit, the second data selection sub-circuit, the third data selection sub-circuit, and the fourth data selection circuit is also electrically connected to a display data line to transmit one of a first data channel signal or a second data channel signal to the connected display data line under control of a selection signal from a connected selection signal line.

12 Claims, 4 Drawing Sheets

(52) U.S. Cl.
CPC ..... *G09G 2300/0443* (2013.01); *G09G 2310/0289* (2013.01); *G09G 2310/06* (2013.01)

(58) Field of Classification Search
CPC ... G09G 2310/0208; G09G 2310/0262; G09G 2310/0264; G09G 2310/0275; G09G 2310/0289; G09G 2310/0297; G09G 2310/06; G09G 2300/04; G09G 2300/0404; G09G 2300/0408; G09G 2300/0443; G09G 2300/08; G09G 2300/0804; G09G 2300/0809; G09G 2300/0823
USPC ..... 345/204, 214, 55
See application file for complete search history.

DISPLAY DRIVING CONTROL CIRCUIT, DISPLAY PANEL AND DRIVING CONTROL METHOD

CROSS-REFERENCE TO RELATED APPLICATION(S)

This application claims priority to Chinese Patent Application No. 201910183962.8, filed on Mar. 11, 2019, which is incorporated herein by reference in its entirety.

TECHNICAL FIELD

The present disclosure relates to the field of display, and more particularly, to a display driving control circuit, a display panel, and a driving control method.

BACKGROUND

As a resolution of a display device increases, a number of data lines to which data needs to be written also increases, which results in a corresponding increase in a number of traces of a display driving control circuit.

SUMMARY

According to a first aspect of the present disclosure, there is provided a display driving control circuit, comprising at least one driving control sub-circuit, wherein each driving control sub-circuit comprises a first data selection sub-circuit, a second data selection sub-circuit, a third data selection sub-circuit, and a fourth data selection circuit, and is configured to provide a signal to a group of display data lines respectively, wherein:

the first data selection sub-circuit is electrically connected to a first selection signal line, a first data channel signal line, and a first display data line of the group of display data lines, and is configured to transmit a first data channel signal from the first data channel signal line to the first display data line under control of a first selection signal from the first selection signal line, the second data selection sub-circuit is electrically connected to a second selection signal line, a second data channel signal line, and a second display data line of the group of display data lines, and is configured to transmit a second data channel signal from the second data channel signal line to the second display data line under control of a second selection signal from the second selection signal line, the third data selection sub-circuit is electrically connected to a third selection signal line, the first data channel signal line, and a third display data line of the group of display data lines, and is configured to transmit the first data channel signal from the first data channel signal line to the third display data line under control of a third selection signal from the third selection signal line, and the fourth data selection sub-circuit is electrically connected to a fourth selection signal line, the second data channel signal line, and a fourth display data line of the group of display data lines, and is configured to transmit the second data channel signal from the second data channel signal line to the fourth display data line under control of a fourth selection signal from the fourth selection signal line.

In one or more embodiments of the present application, the first data selection sub-circuit comprises a first transistor, wherein:

a control electrode of the first transistor is electrically connected to the first selection control line, a first electrode of the first transistor is electrically connected to the first data channel signal line, and a second electrode of the first transistor is electrically connected to the first display data line.

In one or more embodiments of the present application, the second data selection sub-circuit comprises a second transistor, wherein:

a control electrode of the second transistor is electrically connected to the second selection control line, a first electrode of the second transistor is electrically connected to the second data channel signal line, and a second electrode of the second transistor is electrically connected to the second display data line.

In one or more embodiments of the present application, the third data selection sub-circuit comprises a third transistor, wherein:

a control electrode of the third transistor is electrically connected to the third selection control line, a first electrode of the third transistor is electrically connected to the first data channel signal line, and a second electrode of the third transistor is electrically connected to the third display data line.

In one or more embodiments of the present application, the fourth data selection sub-circuit comprises a fourth transistor, wherein:

a control electrode of the fourth transistor is electrically connected to the fourth selection control line, a first electrode of the fourth transistor is electrically connected to the second data channel signal line, and a second electrode of the fourth transistor is electrically connected to the fourth display data line.

In one or more embodiments of the present application, an output polarity of the first data selection sub-circuit is the same as that of the third data selection sub-circuit;

an output polarity of the second data selection sub-circuit is the same as that of the fourth data selection sub-circuit; and the output polarity of the first data selection sub-circuit is opposite to that of the second data selection sub-circuit.

In one or more embodiments of the present application, the display driving control circuit is connected to a display panel comprising red sub-pixels, green sub-pixels, and blue sub-pixels arranged into an array, wherein the first data selection sub-circuit is connected to a first column of sub-pixels, the second data selection sub-circuit is connected to a second column of sub-pixels, the third data selection sub-circuit is connected to a third column of sub-pixels, and the fourth data selection sub-circuit is connected to a fourth column of sub-pixels, wherein the first to fourth columns of sub-pixels are sequentially arranged in the array.

According to a second aspect of the present disclosure, there is provided a driving control method for the display driving control circuit according to the first aspect, comprising:

providing a first selection signal to a fourth selection signal to the first data selection sub-circuit to the fourth data selection sub-circuit through the first selection signal line to the fourth selection signal line respectively, providing a first data channel signal to the first data selection sub-circuit and the third data selection sub-circuit through the first data channel signal line, and providing a second data channel signal to the second data selection sub-circuit and the fourth data selection sub-circuit through the second data channel signal line, so that the first display data line to the fourth display data line sequentially receive data from one of the first data channel signal line or the second data channel signal line in each frame.

In one or more embodiments of the present application, when a data channel signal received by one data selection sub-circuit of the first data selection sub-circuit to the fourth data selection sub-circuit is a signal with a positive polarity, a high level of a selection signal received by said one data selection sub-circuit is a first high level, and a low level of the selection signal received by said one data selection sub-circuit is a second low level; and when a data channel signal received by one data selection sub-circuit of the first data selection sub-circuit to the fourth data selection sub-circuit is a signal with a negative polarity, a high level of a selection signal received by said one data selection sub-circuit is a second high level, and a low level of the selection signal received by said one data selection sub-circuit is a first low level.

In one or more embodiments of the present application, the first high level is 13.5V;

the second high level is 8V;

the first low level is −13.5V; and the second low level is −8V.

In one or more embodiments of the present application, waveforms of the first selection signal and the second selection signal are in-phase waveforms, and amplitudes of the first selection signal and the second selection signal are different at the same time;

waveforms of the third selection signal and the fourth selection signal are in-phase waveforms, and amplitudes of the third selection signal and the fourth selection signal are different at the same time; and the waveforms of the first selection signal and the third selection signal are inverted waveforms.

In one or more embodiments of the present application, two adjacent frames of display data output by each of the first data selection sub-circuit to the fourth data selection sub-circuit have opposite polarities.

In one or more embodiments of the present application, in a first charging time, the first data selection sub-circuit and the second data selection sub-circuit are turned on under control of the first selection signal and the second selection signal, so that the first data channel signal is transmitted to the first display data line, and the second data channel signal is transmitted to the second display data line, and the third data selection sub-circuit and the fourth data selection sub-circuit are turned off under control of the third selection signal and the fourth selection signal; and in a second charging time, the third data selection sub-circuit and the fourth data selection sub-circuit are turned on under control of the third selection signal and the fourth selection signal, so that the first data channel signal is transmitted to the third display data line, and the second data channel signal is transmitted to the fourth display data line, and the first data selection sub-circuit and the second data selection sub-circuit are turned off under control of the first selection signal and the second selection signal.

In one or more embodiments of the present application, each of the first charging time and the second charging time corresponds to one frame respectively, and two frames corresponding to the first charging time and the second charging time are adjacent frames.

According to a third aspect of the present disclosure, there is provided a display panel. The display panel comprises the display driving control circuit according to the first aspect.

BRIEF DESCRIPTION OF THE ACCOMPANYING DRAWINGS

Other features, purposes, and advantages of the present application will become more apparent from the detailed description of non-restrictive embodiments with reference to the following accompanying drawings.

DETAILED DESCRIPTION

The present application will be further described in detail below with reference to the accompanying drawings and the embodiments. It may be understood that the specific embodiments described herein are merely illustrative of the present disclosure, instead of limiting the present disclosure. It should also be illustrated that, for the convenience of description, only parts related to the present disclosure are shown in the accompanying drawings.

It should be illustrated that the embodiments in the present application and the features in the embodiments may be combined with each other without a conflict. The present application will be described in detail below with reference to the accompanying drawings in conjunction with the embodiments.

Figure 1:
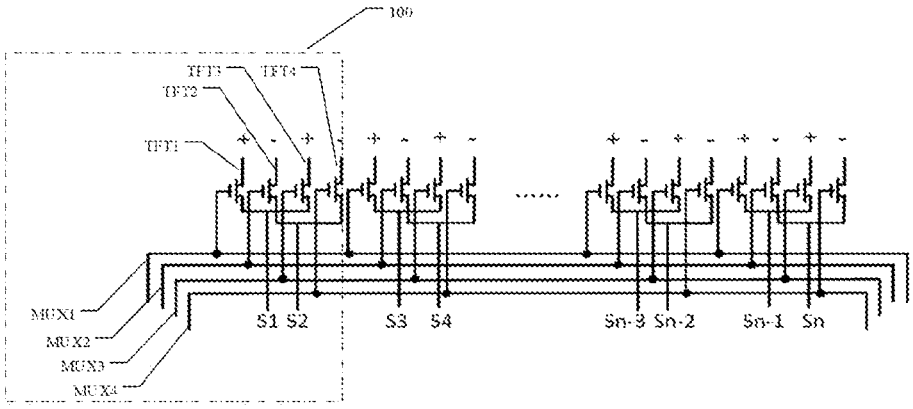
FIG. 1 illustrates an exemplary schematic diagram of a display driving control circuit according to an embodiment of the present application.

As shown in FIG. 1, illustrated is an exemplary schematic diagram of a display driving control circuit according to an embodiment of the present application. As shown, there is disclosed a display driving control circuit which comprises at least one driving control sub-circuit 100. Each driving control sub-circuit 100 comprises four data selection sub-circuits configured to provide a signal to a group of display data lines respectively. Each driving control sub-circuit 100 may be implemented by a transistor, and the embodiment of the present disclosure will be described below by taking the driving control sub-circuit being a transistor as an example.

The first data selection sub-circuit (comprising a first transistor TFT1 in FIG. 1) is electrically connected to a first selection signal line, a first data channel signal line, and a first display data line of the group of display data lines, and is configured to transmit a first data channel signal (S1) from the first data channel signal line to the first display data line under control of a first selection signal (MUX1) from the first selection signal line, the second data selection sub-circuit (comprising a second transistor TFT2 in FIG. 1) is electrically connected to a second selection signal line, a second data channel signal line, and a second display data line of the group of display data lines, and is configured to transmit a second data channel signal (S2) from the second data channel signal line to the second display data line under control of a second selection signal (MUX2) from the second selection signal line, the third data selection sub-circuit (comprising a third transistor TFT3 in FIG. 1) is electrically connected to a third selection signal line, the first data channel signal line, and a third display data line of the group of display data lines, and is configured to transmit the first data channel signal (S1) from the first data channel signal line to the third display data line under control of a third selection signal (MUX3) from the third selection signal line, and the fourth data selection sub-circuit (comprising a fourth transistor TFT4 in FIG. 1) is electrically connected to a fourth selection signal line, the second data channel signal line, and a fourth display data line of the group of display data lines, and is configured to transmit the second data channel signal (S2) from the second data channel signal line to the fourth display data line under control of a fourth selection signal (MUX4) from the fourth selection signal line.

Specifically, a control electrode of the first transistor TFT1 is electrically connected to the first selection control line, a first electrode of the first transistor TFT1 is electrically connected to the first data channel signal line, and a second electrode of the first transistor TFT1 is electrically connected to the first display data line; a control electrode of the second transistor TFT2 is electrically connected to the second selection control line, a first electrode of the second transistor TFT2 is electrically connected to the second data channel signal line, and a second electrode of the second transistor TFT2 is electrically connected to the second display data line; a control electrode of the third transistor TFT3 is electrically connected to the third selection control line, a first electrode of the third transistor TFT3 is electrically connected to the first data channel signal line, and a second electrode of the third transistor TFT3 is electrically connected to the third display data line; and a control electrode of the fourth transistor TFT4 is electrically connected to the fourth selection control line, a first electrode of the fourth transistor TFT4 is electrically connected to the second data channel signal line, and a second electrode of the fourth transistor TFT4 is electrically connected to the fourth display data line. In some embodiments of the present disclosure, a control electrode of a transistor is a gate, a first electrode of the transistor is a source, and a second electrode of the transistor is a drain.

In an embodiment of the present disclosure, in order to save resources for driving a display driving chip while reducing complexity of a circuit for transmitting display data, a data selection sub-circuit design is used, that is, a data channel of the display driving chip provides display data to a plurality of display data lines of a display panel through data selection sub-circuits. A data channel here corresponds to a pin which outputs display data of the display driving chip in hardware.

It should be understood that the entire display driving control circuit may receive n (n is an integer greater than or equal to 2) data channel signals S1 to Sn from the display driving chip, and each driving control sub-circuit 100 in the display driving control circuit selects two of the data channel signals as a first data channel signal and a second data channel signal which are received by itself, which is not limited in the present disclosure herein.

As shown in FIG. 1, each data channel (S1 or S2) of the display driving chip is correspondingly connected to two data selection sub-circuits, which provide display data to display data lines connected thereto. That is, TFT1 and TFT2 are connected to the data channel S1 and provide display data to display data lines connected thereto; and TFT3 and TFT4 are connected to the data channel S2 and provide display data to display data lines connected thereto. The transmission of display data to a corresponding display data line is realized by enabling the selection signals MUX1, MUX2, MUX3, and MUX4 in a time division manner in a row scanning period. In the present embodiment, one data channel provides display data to two data lines of the display panel.

In some embodiments, an output polarity of the first data selection sub-circuit TFT1 is the same as that of the third data selection sub-circuit TFT3;

an output polarity of the second data selection sub-circuit TFT2 is the same as that of the fourth data selection sub-circuit TFT4; and the output polarity of the first data selection sub-circuit TFT1 is opposite to that of the second data selection sub-circuit TFT2.

In order to prevent a common electrode from being biased to a certain polarity by voltage coupling on a data line, a positive and negative alternating driving mode is used in the display panel, that is, polarities on adjacent data lines are opposite. As shown in FIG. 1, the output polarity of the first data selection sub-circuit (i.e., the first transistor TFT1) and the output polarity of the third data selection sub-circuit (i.e., the third transistor TFT3) are positive polarities; the output polarity of the second data selection sub-circuit (i.e., the second transistor TFT2) and the output polarity of the fourth data selection sub-circuit (i.e., the fourth transistor TFT4) are negative polarities; and the output polarity of the first data selection sub-circuit (i.e., the first transistor TFT1) and the output polarity of the second data selection sub-circuit (i.e., the second transistor TFT2) are one positive polarity and one negative polarity. In this way, the same data channel is connected to two data selection sub-circuits with the same output polarity, which saves the power consumption of the same data channel when the polarity is reversed. It should be illustrated that the output polarities of the TFT1, the TFT2, the TFT3, and the TFT4 are the same as those of data channel signals which are received by the TFT1, the TFT2, the TFT3, and the TFT4 respectively.

In some embodiments, the first selection signal, the second selection signal, the third selection signal, and the fourth selection signal may each have a high level for controlling a data selection sub-circuit connected thereto to be turned on and a low level for controlling a data selection sub-circuit connected thereto to be turned off, wherein the high level comprises a first high level H1 and a second high level H2, the first high level H1 being higher than the second high level, and the low level comprises a first low level L1 and a second low level L2, the first low level L1 being lower than the second low level L2.

When a data channel signal received by a data selection sub-circuit is a signal with a positive polarity, a corresponding selection signal is a pulse signal which uses the first high level as a high level and the second low level as a low level; and when a data channel signal received by a data selection sub-circuit is a signal with a negative polarity, a corresponding selection signal is a pulse signal which uses the second high level as a high level and the first low level as a low level.

The data channel signals S1-Sn of the display driving chip are transmitted to the display data lines through the data selection sub-circuits, and therefore switching characteristics of the data selection sub-circuits may directly affect the quality of the data transmission.

Figure 4:
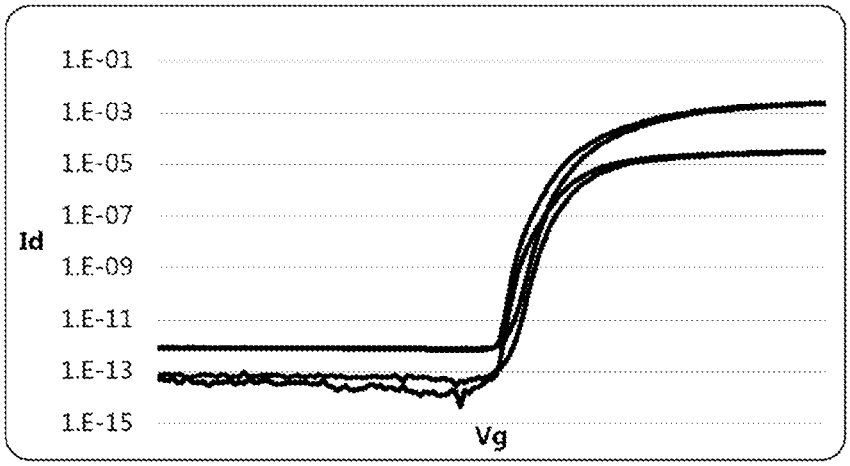
FIG. 4 illustrates an exemplary schematic diagram of switching characteristics of a data selection sub-circuit according to an embodiment of the present application.
Figure 5:
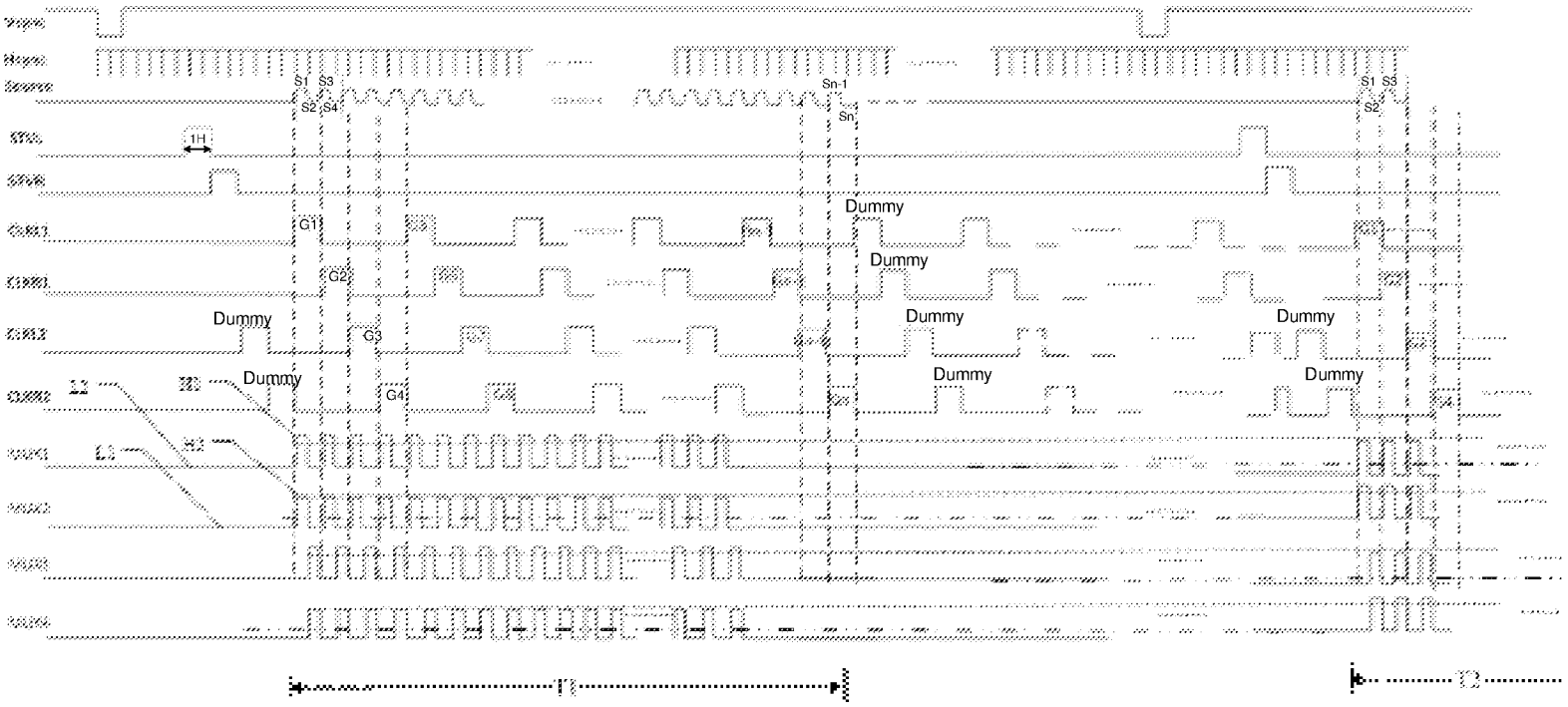
FIG. 5 illustrates an exemplary timing diagram of a display driving control circuit according to an embodiment of the present application.

Description will be made below with reference to FIGS. 4 and 5. FIG. 4 illustrates an exemplary schematic diagram of switching characteristics of a data selection sub-circuit according to an embodiment of the present application; and FIG. 5 illustrates an exemplary timing diagram of a display driving control circuit according to an embodiment of the present application. As shown in FIG. 4, a voltage difference Vgs between a gate G and a source S of a transistor in the data selection sub-circuit determines turn-on and turn-off of the data selection sub-circuit, and current at a drain thereof changes as the voltage Vgs changes. The switching characteristics of the transistor when a value of Vgs is about 0 volts are not ideal. For example, turn-on characteristics when Vgs is between 0 and 3 volts (transistors of different manufacturers have different switching characteristics) may reduce the efficiency of charging a corresponding display data line, and leakage current which is generated when the value of Vgs is between 0 and −3 volts may also reduce the charging efficiency.

In practical applications, the gate of the transistor in the data selection sub-circuit is connected to a selection signal line, the source of the transistor in the data selection sub-circuit is connected to the data channel signal S1-Sn of the display driving chip, the drain of the transistor in the data selection sub-circuit is used as an output, and turn-on and turn-off of the transistor is controlled by controlling the gate to be at a high level or a low level through a selection signal. In the present embodiment, voltage values of the data channel signals S1-Sn are in a range of 5.5V to −5.5V. For example, a turn-on level on the gate of the transistor of the data selection sub-circuit is 8V, a turn-off level on the gate of the transistor of the data selection sub-circuit is −8V, a maximum positive voltage received by the source of the transistor of the data selection sub-circuit is 5.5V, and a minimum negative voltage received by the source of the transistor of the data selection sub-circuit is −5.5V. When the voltage at the source terminal is the minimum negative voltage, Vgs=8−(−5.5V)=13.5V in a turn-on condition and Vgs=−8−(−5.5)=−2.5V in a turn-off condition; and when the voltage at the source terminal is the maximum positive voltage, Vgs=8−5.5=2.5V in a turn-on condition and Vgs=−8−5=−13.5V in a turn-off condition. Thus, when the source has a negative polarity, the transistor has poor turn-off characteristics, and there may be a current leakage condition; and when the source has a positive polarity, the transistor has poor turn-on characteristics, which may affect input of display data to the display data line, and thus affect the charging rate of a pixel. Thereby, a voltage which is charged to the pixel may be affected for a certain charging time, which in turn causes poor display.

The switching characteristics of the data selection sub-circuit may be improved by adjusting a voltage of the selection signal. For example, the voltage of the selection signal when the transistor is turned on is adjusted to 13.5V, and the voltage of the selection signal when the transistor is turned off is adjusted to −13.5V to maintain the voltage Vgs, and ensure the switching characteristics of the transistor, thereby improving the charging rate. When the maximum positive voltage received by the source of the transistor in the data selection sub-circuit is 5.5V, Vgs=13.5V−5.5V=8V in a case that the transistor is turned on, and Vgs=−8V−5.5V=−13.5 in a case that the transistor is turned off, which may ensure normal turn-on and turn-off of the transistor; and when the minimum negative voltage received by the source of the transistor in the data selection sub-circuit is −5.5V, Vgs=8V−(−5.5V)=13.5V in a case that the transistor is turned on, and Vgs=−13.5V−(−5.5V)=−8V in a case that the transistor is turned off, which may ensure normal turn-on and turn-off of the transistor.

Therefore, as shown in FIG. 5, the data channel signal received by the first electrode of the transistor of the data selection sub-circuit controlled by the first selection signal MUX1 has a positive polarity, and the first selection signal MUX1 uses the first high level H1 and the second low level L2, which have voltage values of 13.5V and −8V respectively; and the data channel signal received by the first electrode of the transistor of the data selection sub-circuit controlled by the second selection signal MUX2 ha a negative polarity, and the second selection signal MUX2 uses the second high level H2 and the first low level L1, which have voltage values of 8V and −13.5V respectively. Similarly, values of high levels and low levels of the third selection signal MUX3 and the fourth selection signal are also determined according to the positive and negative polarities of the data channel signal received by the first electrode of the transistor of the controlled data selection sub-circuit.

It should be illustrated that the signal of the data channel of the display driving chip connected to the source of the transistor of the data selection sub-circuit is between 5.5V and −5.5V, which only gives conditions of two end points, and if the two end points may satisfy requirements, intermediate values therebetween may also satisfy the requirements, and will not be described here. In addition, the maximum/minimum output voltage values 5.5V/−5.5V of the data channel of the display driving chip are only an example. In practical applications, specific values thereof may be different, and a voltage value of the selection signal may be set according to an application scenario.

Figure 2:
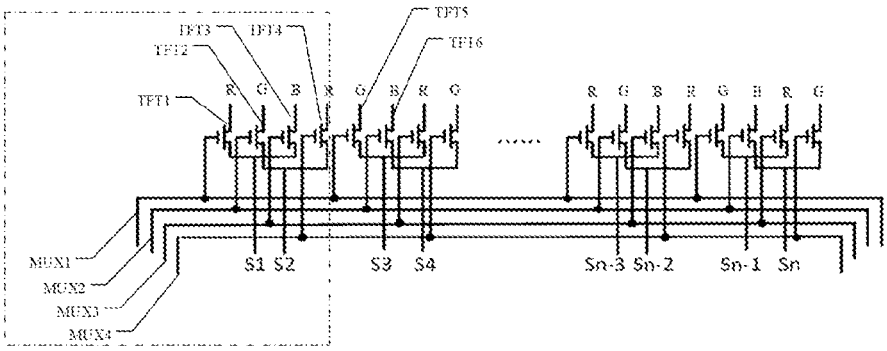
FIG. 2 illustrates an exemplary schematic diagram of a display driving control circuit according to another embodiment of the present application.

FIG. 2 illustrates an exemplary schematic diagram of a display driving control circuit according to another embodiment of the present application. As shown in FIG. 2, the display driving control circuit comprises a first data selection sub-circuit (comprising a first transistor TFT1 in FIG. 2), a second data selection sub-circuit (comprising a second transistor TFT2 in FIG. 2), a third data selection sub-circuit (comprising a third transistor TFT3 in FIG. 2), and a fourth data selection sub-circuit (comprising a fourth transistor TFT4 in FIG. 2). The display driving control circuit may be connected to a display panel comprising red sub-pixels R, green sub-pixels G, and blue sub-pixels B, which are arranged into an array. The first data selection sub-circuit is connected to a first column of sub-pixels, the second data selection sub-circuit is connected to second first column of sub-pixels, the third data selection sub-circuit is connected to a third column of sub-pixels, and the fourth data selection sub-circuit is connected to a fourth column of sub-pixels, wherein the first to fourth columns of sub-pixels are sequentially arranged in the array.

As shown in FIG. 2, the sub-pixels R, G and B may be arranged in the array in a cyclically repeated manner, such that a first data selection sub-circuit (e.g., the first transistor TFT1), a second data selection sub-circuit (e.g., the second transistor TFT2), and a third data selection sub-circuit (e.g., the third transistor TFT3) of a first driving control sub-circuit may output display data to a red sub-pixel R, a green sub-pixel G, and a blue sub-pixel G of a first pixel unit respectively. The fourth data selection sub-circuit (e.g., the fourth transistor TFT4) of the first driving control sub-circuit as well as a first data selection sub-circuit (e.g., a fifth transistor TFT5) and a second data selection sub-circuit (e.g., a sixth transistor TFT6) of a second driving control sub-circuit may output display data to a R sub-pixel, a G sub-pixel, and a B sub-pixel of a second pixel unit respectively.

A connection between each of other data selection sub-circuits and respective sub-pixels is similar to that described above.

Figure 3:
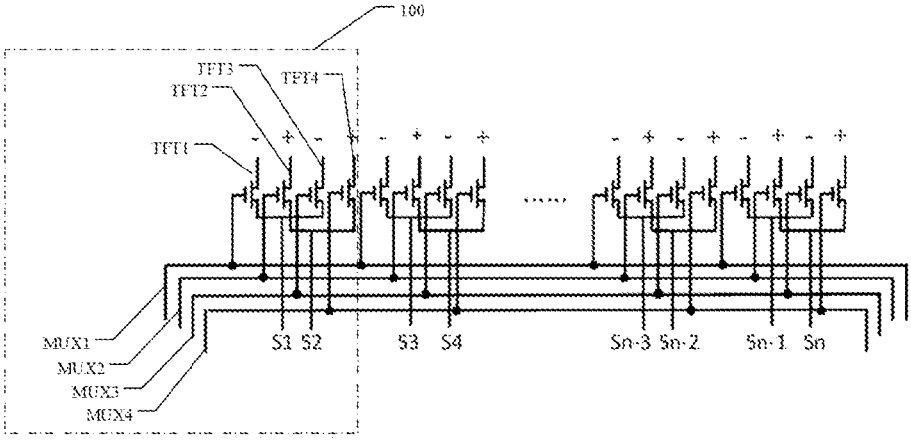
FIG. 3 illustrates an exemplary schematic diagram of a display driving control circuit according to yet another embodiment of the present application.

FIG. 3 illustrates an exemplary schematic diagram of a display driving control circuit according to yet another embodiment of the present application. As shown in FIG. 3, two adjacent frames of display data output by the same data selection sub-circuit have opposite polarities.

Specifically, in order to prevent a liquid crystal panel from being polarized, a column flipping manner is generally used, which realizes polarity inversion of a voltage of the same display data line when data of two adjacent frames is displayed. For example, the display data output by the first data selection sub-circuit has a positive polarity in an $n^{th}$ frame (as shown in FIG. 2), and has a negative polarity in an $(n+1)^{th}$ frame (as shown in FIG. 3). FIG. 2 differs from FIG. 3 in that an output polarity of the same data selection sub-circuit is reverted when data of adjacent frames is displayed.

Figure 6:
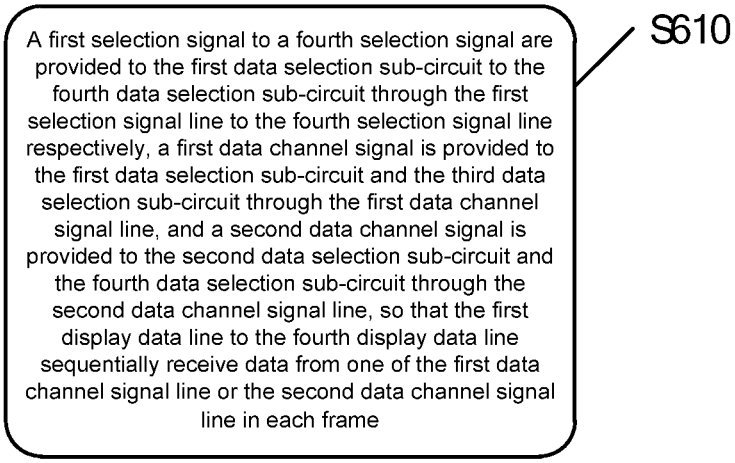
FIG. 6 illustrates a flowchart of a driving method for a display driving control circuit according to an embodiment of the present application.

The application further provides a display driving control method. FIG. 5 illustrates an exemplary timing diagram of a display driving control circuit according to an embodiment of the present application. FIG. 6 illustrates a flowchart of a driving method for a display driving control circuit according to an embodiment of the present application.

In step S610 of the driving method, a first selection signal to a fourth selection signal are provided to the first data selection sub-circuit to the fourth data selection sub-circuit through the first selection signal line to the fourth selection signal line respectively, a first data channel signal is provided to the first data selection sub-circuit and the third data selection sub-circuit through the first data channel signal line, and a second data channel signal is provided to the second data selection sub-circuit and the fourth data selection sub-circuit through the second data channel signal line, so that the first display data line to the fourth display data line sequentially receive data from one of the first data channel signal line or the second data channel signal line in each frame.

Specifically, in a first charging time T1, the first transistor TFT1 and the second transistor TFT2 are turned on under control of the first selection signal MUX1 and the second selection signal MUX2, so that the first data channel signal S1 is transmitted to the first display data line, and the second data channel signal S2 is transmitted to the second display data line, and the third transistor TFT3 and the fourth transistor TFT4 are turned off under control of the third selection signal MUX3 and the fourth selection signal MUX4; and in a second charging time T2, the third transistor TFT3 and the fourth transistor TFT4 are turned on under control of the third selection signal MUX3 and the fourth selection signal MUX4, so that the first data channel signal S1 is transmitted to the third display data line, and the second data channel signal S2 is transmitted to the fourth display data line, and the first transistor TFT1 and the second transistor TFT2 are turned off under control of the first selection signal MUX1 and the second selection signal MUX2.

Each of the first charging time and the second charging time corresponds to one frame respectively, and two frames corresponding to the first charging time and the second charging time are adjacent frames.

In some embodiments, when a data channel signal received by one data selection sub-circuit of the first data selection sub-circuit to the fourth data selection sub-circuit is a signal with a positive polarity, a high level of a selection signal received by said one data selection sub-circuit is a first high level, and a low level of the selection signal received by said one data selection sub-circuit is a second low level; and when a data channel signal received by one data selection sub-circuit of the first data selection sub-circuit to the fourth data selection sub-circuit is a signal with a negative polarity, a high level of a selection signal received by said one data selection sub-circuit is a second high level, and a low level of the selection signal received by said one data selection sub-circuit is a first low level.

In some embodiments, the first high level is 13.5V;

the second high level is 8V;

the first low level is −13.5V; and the second low level is −8V.

In some embodiments,

It should be illustrated that an $n^{th}$ frame image is displayed in the first charging time T1, and an $(n+1)^{th}$ frame image is displayed in the second charging time T2. Display data of two adjacent frames output by the same data selection sub-circuit has opposite polarities. Therefore, when the data channel signal received by the first transistor TFT1 in the first charging time has a positive polarity, the data channel signal received by the first transistor TFT1 in the second charging time has a negative polarity. Thus, in the first charging time, the first selection signal MUX1 uses the first high level H1 and the second low level L2, and in the second charging time, the first selection signal MUX1 uses the second high level H2 and the first low level L1.

In some embodiments, waveforms of the first selection signal and the second selection signal are in-phase waveforms;

waveforms of the third selection signal and the fourth selection signal are in-phase waveforms; and the waveforms of the first selection signal and the third selection signal are inverted waveforms.

That is, amplitudes of the waveforms of the first selection signal and the second selection signal are both high or low at the same time. One of the waveforms of the first selection signal and the third selection signal has high amplitude and the other has low amplitude at the same time.

In some embodiments, the first selection signal, the second selection signal, the third selection signal, and the fourth selection signal are pulse signals which are different from each other.

As shown in FIG. 5, the waveforms of the first selection signal MUX1 and the second selection signal MUX2 are in-phase waveforms, but data channel signals received by first electrodes of transistors of data selection sub-circuit which are controlled at the same time have opposite polarities. Therefore, amplitudes of the waveforms of the first selection signal MUX1 and the second selection signal MUX2 are different. Similarly, the waveforms of the third selection signal MUX3 and the fourth selection signal MUX4 are in-phase waveforms, and have different amplitudes at the same time.

Figure 7:
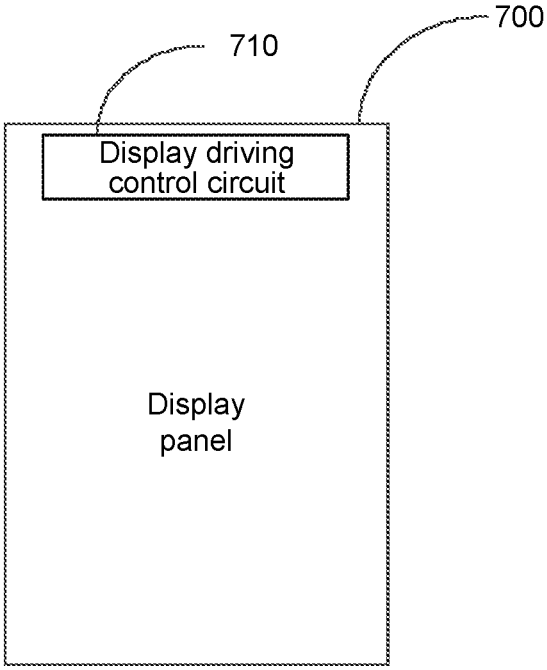
FIG. 7 illustrates a display panel according to an embodiment of the present application.

FIG. 7 illustrates a display panel 700 according to an embodiment of the present application. As shown in FIG. 7, the display panel 700 comprises a display driving control circuit 910. The display driving control circuit 910 may be implemented by the display driving control circuit according to any of the embodiments of the present disclosure.

The above description is only a preferred embodiment of the present application and a description of the principles of the applied technology. It should be understood by those skilled in the art that the disclosed scope of the present application is not limited to the technical solutions formed by a specific combination of the above technical features, and should also be covered by other technical solutions formed by any combination of the above technical features or equivalent features thereof without departing from the concept of the present disclosure, for example, technical solutions formed by substitution of the above features with (but not limited to) technical features which are disclosed in the present application and have similar functions.

We claim:

1. A driving control method for the display driving control circuit, the display driving control circuit comprising at least one driving control sub-circuit, wherein each driving control sub-circuit comprises a first data selection sub-circuit, a second data selection sub-circuit, a third data selection sub-circuit, and a fourth data selection circuit, and each driving control sub-circuit is configured to provide a signal to a group of display data lines respectively, wherein:

the first data selection sub-circuit is electrically connected to a first selection signal line, a first data channel signal line, and a first display data line of the group of display data lines, and is configured to transmit a first data channel signal from the first data channel signal line to the first display data line under control of a first selection signal from the first selection signal line;

the second data selection sub-circuit is electrically connected to a second selection signal line, a second data channel signal line, and a second display data line of the group of display data lines, and is configured to transmit a second data channel signal from the second data channel signal line to the second display data line under control of a second selection signal from the second selection signal line;

the third data selection sub-circuit is electrically connected to a third selection signal line, the first data channel signal line, and a third display data line of the group of display data lines, and is configured to transmit the first data channel signal from the first data channel signal line to the third display data line under control of a third selection signal from the third selection signal line; and the fourth data selection sub-circuit is electrically connected to a fourth selection signal line, the second data channel signal line, and a fourth display data line of the group of display data lines, and is configured to transmit the second data channel signal from the second data channel signal line to the fourth display data line under control of a fourth selection signal from the fourth selection signal line, the method comprising:

providing a first selection signal, a second selection signal, a third selection signal and a fourth selection signal to the first data selection sub-circuit, the second data selection sub-circuit, the third data selection sub-circuit and the fourth data selection sub-circuit through the first selection signal line, the second selection signal line, the third selection signal line and the fourth selection signal line, respectively; and providing a first data channel signal to the first data selection sub-circuit and the third data selection sub-circuit through the first data channel signal line, and providing a second data channel signal to the second data selection sub-circuit and the fourth data selection sub-circuit through the second data channel signal line, so that the first display data line, the second display data line, the third display data line and the fourth display data line sequentially receive data from one of the first data channel signal line or the second data channel signal line in each frame, wherein:

when a data channel signal received by one data selection sub-circuit of the first data selection sub-circuit, the second data selection sub-circuit, the third data selection sub-circuit or the fourth data selection sub-circuit is a signal with a positive polarity, a high level of a selection signal received by said one data selection sub-circuit is a first high level, and a low level of the selection signal received by said one data selection sub-circuit is a second low level, the first high level is a positive level, the second low level is a negative level, and an absolute value of the first high level is equal to an absolute value of the second low level plus an absolute value of a highest level of the data channel signal; and when a data channel signal received by one data selection sub-circuit of the first data selection sub-circuit, the second data selection sub-circuit, the third data selection sub-circuit or the fourth data selection sub-circuit is a signal with a negative polarity, a high level of a selection signal received by said one data selection sub-circuit is a second high level, and a low level of the selection signal received by said one data selection sub-circuit is a first low level, the second high level is a positive level, the first low level is a negative level, an absolute value of the second high level is equal to the absolute value of the second low level, and an absolute value of the first low level is equal to the absolute value of the second high level plus an absolute value of a lowest level of the data channel signal.

2. The driving control method according to claim 1, wherein:

the first high level is 13.5V;

the second high level is 8V;

the first low level is −13.5V; and the second low level is −8V.

3. The driving control method according to claim 1, wherein:

waveforms of the first selection signal and the second selection signal are in-phase waveforms, and amplitudes of the first selection signal and the second selection signal are different at the same time;

waveforms of the third selection signal and the fourth selection signal are in-phase waveforms, and amplitudes of the third selection signal and the fourth selection signal are different at the same time; and the waveforms of the first selection signal and the third selection signal are inverted waveforms.

4. The driving control method according to claim 1, wherein two adjacent frames of display data output by each of the first data selection sub-circuit, the second data selection sub-circuit, the third data selection sub-circuit and the fourth data selection sub-circuit have opposite polarities.

5. The driving control method according to claim 1, wherein:

in a first charging time, the first data selection sub-circuit and the second data selection sub-circuit are turned on under control of the first selection signal and the second selection signal, so that the first data channel signal is transmitted to the first display data line, and the second data channel signal is transmitted to the second display data line, and the third data selection sub-circuit and the fourth data selection sub-circuit are turned off under control of the third selection signal and the fourth selection signal; and in a second charging time, the third data selection sub-circuit and the fourth data selection sub-circuit are turned on under control of the third selection signal and the fourth selection signal, so that the first data channel signal is transmitted to the third display data line, and the second data channel signal is transmitted to the fourth display data line, and the first data selection sub-circuit and the second data selection sub-circuit are turned off under control of the first selection signal and the second selection signal.

6. The driving control method according to claim 5, wherein each of the first charging time and the second charging time corresponds to one frame, respectively, and two frames corresponding to the first charging time and the second charging time are adjacent frames.

7. The driving control method according to claim 1, wherein the first data selection sub-circuit comprises a first transistor, and wherein:

a control electrode of the first transistor is electrically connected to the first selection control line, a first electrode of the first transistor is electrically connected to the first data channel signal line, and a second electrode of the first transistor is electrically connected to the first display data line.

8. The driving control method according to claim 7, wherein the second data selection sub-circuit comprises a second transistor, and wherein:

a control electrode of the second transistor is electrically connected to the second selection control line, a first electrode of the second transistor is electrically connected to the second data channel signal line, and a second electrode of the second transistor is electrically connected to the second display data line.

9. The driving control method according to claim 8, wherein the third data selection sub-circuit comprises a third transistor, and wherein:

a control electrode of the third transistor is electrically connected to the third selection control line, a first electrode of the third transistor is electrically connected to the first data channel signal line, and a second electrode of the third transistor is electrically connected to the third display data line.

10. The driving control method according to claim 9, wherein the fourth data selection sub-circuit comprises a fourth transistor, and wherein:

a control electrode of the fourth transistor is electrically connected to the fourth selection control line, a first electrode of the fourth transistor is electrically connected to the second data channel signal line, and a second electrode of the fourth transistor is electrically connected to the fourth display data line.

11. The driving control method according to claim 1, wherein:

an output polarity of the first data selection sub-circuit is the same as that of the third data selection sub-circuit;

an output polarity of the second data selection sub-circuit is the same as that of the fourth data selection sub-circuit; and the output polarity of the first data selection sub-circuit is opposite to that of the second data selection sub-circuit.

12. The driving control method according to claim 1, wherein the display driving control circuit is connected to a display panel comprising red sub-pixels, green sub-pixels, and blue sub-pixels arranged into an array, wherein the first data selection sub-circuit is connected to a first column of sub-pixels, the second data selection sub-circuit is connected to a second column of sub-pixels, the third data selection sub-circuit is connected to a third column of sub-pixels, and the fourth data selection sub-circuit is connected to a fourth column of sub-pixels, wherein the first to fourth columns of sub-pixels are sequentially arranged in the array.

* * * * *